US010344405B2

(12) United States Patent
Vondruska et al.

(10) Patent No.: US 10,344,405 B2
(45) Date of Patent: Jul. 9, 2019

(54) DEVICE FOR CLEANING ROLLER SURFACES OF A DRAFTING ARRANGEMENT

(71) Applicant: Maschinenfabrik Rieter AG, Winterthur (CH)

(72) Inventors: Jindrich Vondruska, Brno (CZ); Felix Keller, Wilen B. Wil (CH); Lauro Peter, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 365 days.

(21) Appl. No.: 15/308,976

(22) PCT Filed: Apr. 14, 2015

(86) PCT No.: PCT/IB2015/000478
§ 371 (c)(1),
(2) Date: Nov. 4, 2016

(87) PCT Pub. No.: WO2015/170154
PCT Pub. Date: Nov. 12, 2015

(65) Prior Publication Data

US 2017/0073850 A1 Mar. 16, 2017

(30) Foreign Application Priority Data

May 6, 2014 (CH) ..... 0673/14

(51) Int. Cl.
*D01H 5/62* (2006.01)

(52) U.S. Cl.
CPC ..... *D01H 5/625* (2013.01)

(58) Field of Classification Search
CPC ..... D01H 5/625
See application file for complete search history.

(56) References Cited

U.S. PATENT DOCUMENTS 3,074,121 A 1/1963 Barr et al.
3,101,504 A * 8/1963 Gasser ..... D01H 5/625 15/256.51

(Continued)

FOREIGN PATENT DOCUMENTS

DE 11 30 336 B 5/1962
DE 12 66 190 B 4/1968

(Continued)

OTHER PUBLICATIONS

PCT Search Report, dated Jul. 14, 2015.

*Primary Examiner* — Shaun R Hurley
(74) *Attorney, Agent, or Firm* — Dority & Manning, P.A.

(57) ABSTRACT

A spinning preparation machine for processing a fiber material includes a drafting system that moves the fiber material in a direction of conveyance and includes a plurality of roller pairs arranged one after the other with upper rollers and lower rollers. Elongated stripping devices having a stripping edge are in contact with the upper rolls to remove dirt and other contaminants therefrom. A suction hood is mounted above the stripping devices and is connected to a vacuum source. Each stripping device is mounted in an individual respective suction channel, and the stripping edge of the stripping device protrudes through a first opening in the respective suction channel. Each suction channel is mounted on a bottom wall having openings therein and includes a second opening opposite the first opening that is aligned opposite from one of the openings in the bottom wall. The suction hood protrudes beyond the openings in the bottom wall and is mounted on a side of the bottom wall opposite the suction channels.

12 Claims, 3 Drawing Sheets

(56) References Cited

U.S. PATENT DOCUMENTS

| | | | | |
|---|---|---|---|---|
| 3,251,101 | A * | 5/1966 | Ingham, Jr. | D01H 5/625 15/306.1 |
| 3,431,717 | A * | 3/1969 | Avera | D01H 5/625 15/256.51 |
| 4,745,738 | A * | 5/1988 | Stahlecker | D01H 4/26 57/301 |
| 2006/0143872 | A1 * | 7/2006 | Cherif | D01H 1/16 19/236 |

FOREIGN PATENT DOCUMENTS

| | | | |
|---|---|---|---|
| DE | 25 27 714 | A | 1/1977 |
| DE | 38 29 490 | A1 | 3/1990 |
| EP | 1 652 975 | A2 | 5/2006 |
| EP | 1 700 937 | A2 | 9/2006 |

* cited by examiner

DEVICE FOR CLEANING ROLLER SURFACES OF A DRAFTING ARRANGEMENT

FIELD OF THE INVENTION

The invention relates to an apparatus on a spinning preparation machine having a drafting system, with a plurality of roller pairs arranged one after the other with upper rollers and lower rollers. At least two elongated stripping devices are in contact with one of the upper rollers with their stripping edges. A suction hood is arranged above the stripper devices and is connected to a vacuum source.

BACKGROUND

In order to remove the dirt and other constituents deposited on the upper rollers of a drafting system during operation, stripping apparatuses whose stripping edges are in contact with the circumferential surface of the rollers at a certain contact pressure are used in practice. For example, flexible strippers, which are in contact with the circumference of the rollers at a certain angle of attack and at a certain prestress, are used. The flexible strippers are usually fastened to a holder, by means of which they are fastened to the drafting system.

Such an apparatus is known, for example, from EP 1 700 937 B1. To remove the material stripped by the strippers of the stripping device from the area of the upper rollers, a suction hood is provided above the stripping apparatus, the hood being connected to a vacuum source.

In order to prevent accumulation of the components stripped off on the respective stripper, the strippers are periodically lifted up from the circumferential surface of the rollers to be stripped periodically at certain intervals by means of a suitably mounted adjusting device or shifted horizontally with respect to the axle of the roller.

Such apparatuses are known in general as indicated, for example, in EP 1 700 937 B1 and also DE 38 29 490 A1.

The tendency to constantly increase machine productivity also results in higher rotational speeds of the upper rollers and lower rollers on the drafting systems. This in turn results in the fact that the amount of material strip brought by the stripper apparatuses per unit of time is increased. This may result in the apparatuses known in the past no longer being capable of removing the stripped off material (dirt, fibers mixed with honeydew and other components) continuously from the area of the stripper. This can result in accumulations in this area and can ultimately cause interfere with the drawing operation. On the one hand, this has a negative impact on the stripping function of the respective stripper, while on the other hand such accumulations, when they become loosened by the stripper, can enter the clamping gap between the upper roller and the lower roller and thus have a negative effect on the drawing operation. This can result in the formation of an irregular fiber sliver, which is formed downstream from the drafting system.

SUMMARY OF THE INVENTION

An object of the present invention is thus to eliminate the disadvantages of the known embodiments and to propose an apparatus by which the material stripped off by the strippers from roller surfaces can also be removed reliably from the stripping area even at high rotational speeds. Additional objects and advantages of the invention will be set forth in part in the following description, or may be obvious from the description, or may be learned through practice of the invention.

To achieve this object, it is proposed that each of the stripping devices be mounted on its own suction channel, wherein the stripping edge of the respective stripping device protrudes beyond the suction channel assigned to it in the area of a first opening in the suction channel and the suction channels are mounted on a bottom wall provided with openings. The respective suction channel is provided with a second opening opposite the first opening, the second opening being opposite one of the openings in the bottom wall. The suction hood protrudes beyond the openings in the bottom wall and is mounted on the side of the bottom wall opposite the suction channels.

Due to the proposal to mount each stripping apparatus on an individual suction channel, it is possible to coordinate and/or design the respective suction channel with the stripping device used, so that a sufficient air flow is created in this area to safely and rapidly transfer the stripped material to a downstream suction hood connected to a vacuum source. Therefore, no unwanted accumulations of stripped material can accumulate in the stripping area.

Such an apparatus claimed according to the invention may also be used for stripping lower rollers.

To be able to adapt the stripping apparatus to an adjustment of the drawing distances (distance between the clamping lines of successive pairs of rollers) in a drawing range (pre-drawing range or main drawing range) of the drafting system, it is proposed that at least one of the suction channels be displaceable transversely to the longitudinal direction of the stripping devices and mounted on the bottom wall so that it is displaceable. This makes it possible to align the stripping device to the new position of the upper roller to be stripped without having to adjust the bottom wall.

It is preferably proposed here that, as seen in the region of the suction channel mounted displaceably and transversely to the longitudinal direction of the respective stripping device, the width dimension of the opening provided in the bottom wall is larger than the width dimension of the second opening in the suction channel which is opposite the respective opening in the bottom wall. This ensures that the second opening in the respective suction channel is still opposite a through-opening in the bottom wall which is at least as large in terms of area after the adjustment.

In addition, it is proposed that the respective displaceable suction channel be provided with cover elements in the area of its second opening so that the area of the opening of the bottom wall of the suction channel is closed by means of these cover elements, protruding beyond the region of the second opening of the displaceable suction channel. This ensures that no openings will be exposed due to the shifting of the suction channels by means of which the ambient air of the drafting system could directly enter the interior of the suction hood, bypassing the suction channels.

This would reduce the suction power in the suction channels.

It is also proposed that the front and rear channel walls of the respective suction channel shall have a distance between 2 and 10 mm from the stripping device—as seen transversely to the longitudinal direction of the stripping devices and in the direction of conveyance—said stripping devices being mounted on the suction channel at their ends as seen in the longitudinal direction of the stripping device.

In other words, the stripping device in a proposed embodiment is situated at least partially inside the suction channel and has air flowing around it on both of its two longitudinal sides due to the applied vacuum and is thus kept completely clean.

The distance between the stripping device and the respective channel wall is to be designed so that on the one hand no blockage occurs due to the clearance being too small and on the other hand the clearance also should not be too large, so that a sufficient air velocity is still ensured within the suction channel in order to transfer the stripped material to the suction hood.

To prevent adhesion of fibers in the area of the stripping edge, wherein the fibers with their ends may lie around the stripper, it is proposed that the distances of the stripping device from the front and rear channel walls should be different.

Different passage sections for the air flow are thus achieved with respect to front and rear sides of the stripping device. This results in a difference in air flow on the front and rear sides of the stripping device. This makes it possible for fibers placed around the stripper to become loosened and be sucked away.

In addition, an embodiment in which the stripping device is mounted in an extension of the front channel wall and is a distance between 8 and 20 mm from the rear channel wall of the suction channel, which it is at least partially opposite, is also advantageously proposed—as seen across the longitudinal direction of the stripping devices and in the direction of conveyance F.

This permits a simple mounting of the stripping device and ensures that the assigned suction channel is completely available with its cross section for the suction process. Due to the flexibility of the stripper, the material stripped off is entrained in the direction of rotation of the upper roller and transferred downstream from the stripper. In this position, this material is immediately picked up by the applied suction air stream of the suction channel and thereby removed.

In addition, it is proposed that the bottom wall be fastened to a frame that is mounted so that it is pivotable by means of a pivot axis on a machine frame, wherein the pivot axis runs parallel to the longitudinal direction of the stripping devices and the bearings of the upper rollers of the drafting system are mounted on the frame. The entire apparatus with the stripping devices can thus be pivoted completely into an out-of-operation position in which the lower area of the drafting system is accessible with the lower rollers.

To eliminate possible deposits during operation in the area of the stripping edges (e.g., due to adhering fibers mixed with honeydew), it is proposed that the bottom wall be mounted on the frame, so that it is movable transversely to the longitudinal direction of the stripper device and is held by means of at least one spring element in a working position wherein the spring element(s) is/are on the one hand supported on the frame and on the other hand supported on the bottom plate and is/are displaceable with an adjusting means mounted between the frame and the bottom wall, by means of said adjusting means the bottom wall being periodically displaceable as seen transverse to the longitudinal directions of the stripping devices.

If it should happen that material adheres in the area of the stripping edges, despite the suction effect, which is normally sufficient in the area of the suction channel, then there is the possibility of releasing this material by brief displacement or raising of the stripping device from the roller surface and then removing the material by suction. Since the flexible stripper of the stripping device lies in contact with the roller surface under a prestress, in the periodic movement away described here, the stripper snaps back into an extended position. Even as a result of this recoil, adhering pieces of material can become loosened in the area of the stripping edge and can then be removed by suction. Periodic raising supports this effect. Use of a pneumatically operable bellows cylinder is preferably proposed as an adjusting means. This makes it possible to create periodic oscillating movements in short intervals (e.g., 1 to 2 minutes) without having to move the large masses of the adjusting device.

It is also possible to combine the adjusting means for the periodic back-and-forth movement and the restoring means in the form of a spring element in a common device (e.g., cylinder combined with spring element).

It is additionally proposed that the suction hood be provided with peripheral sealing elements, by means of which the suction hood is held in contact with the bottom wall and is held by fastening means. This permits a rapid and simple fastening of the suction hood on the bottom wall with a secure seal with respect to the ambient air. Dismantling of the suction hood can be accomplished very easily and ensures rapid access in the area of the second opening of the respective suction channels for cleaning purposes.

For better monitoring of soiling (material accumulations within the suction hood), it is proposed that the hood be designed of a transparent material.

Additional advantages of the invention will now be presented and described in greater detail on the basis of the following exemplary embodiments.

DETAILED DESCRIPTION

Figure 1:
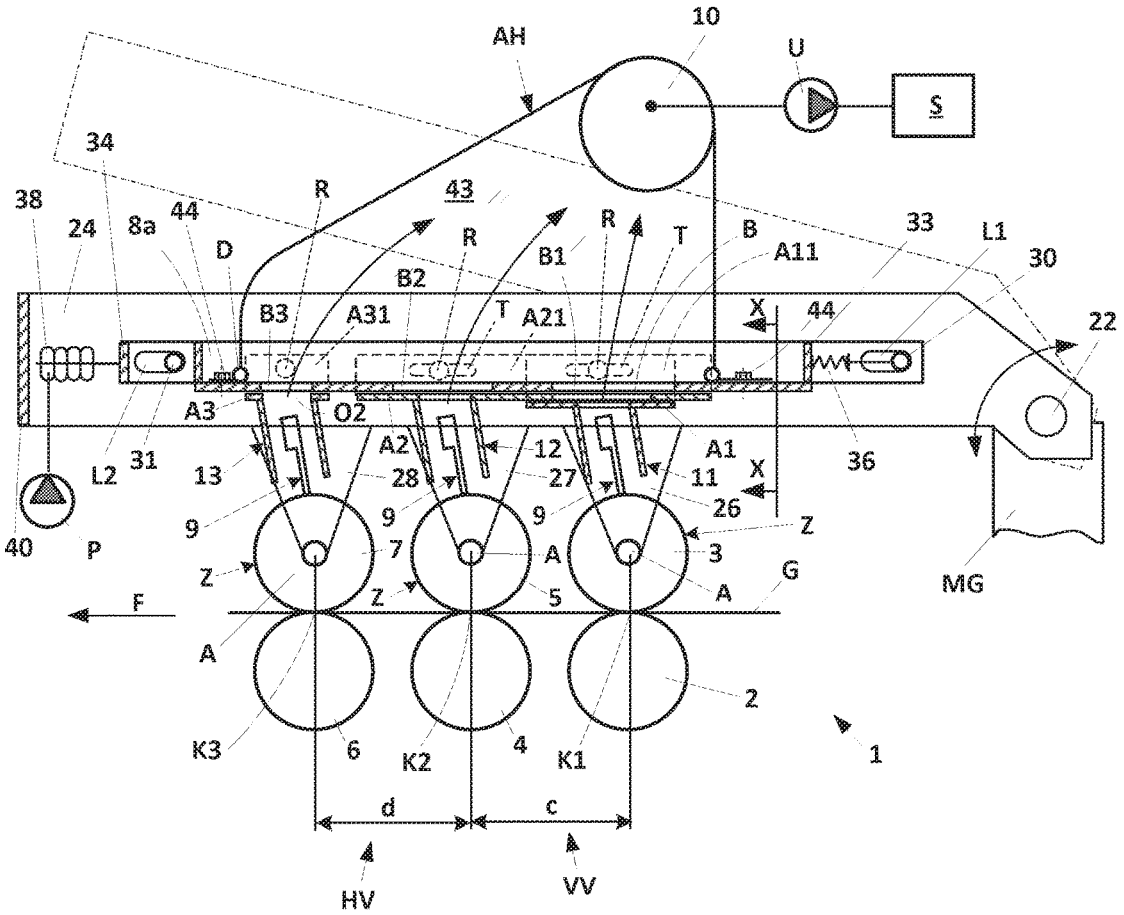
FIG. 1 shows a schematic side view of a drafting system having a stripping device designed according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic side view of a drafting system 1 which is equipped with roller pairs 2, 3; 4, 5; and 6, 7 arranged one after the other. These roller pairs are provided for processing fiber material G in a pre-drawing zone VV and a main drawing zone HV. The fiber material G to be drawn is moved in the conveyor direction F by the drafting system 1. The lower rollers 2, 4, 6, which are connected to drive means (not shown), are usually embodied as profiled steel rollers and are mounted so they can rotate in a machine frame MG. The upper rollers 3, 5, 7 (also referred to as pressure rollers) assigned to the lower rollers usually have a rubberized surface (peripheral surface) Z and are pressed against the suitably assigned lower roller 2, 4 or 6 by means of a device that is not shown here during operation, to form a clamping site K1, K2, K3. The upper rollers 3, 5, 7 are mounted so they can rotate by means of axles A in bearings 26, 27, 28 and are driven by means of friction by the respective lower rollers 2, 4, 6, which cooperate with them. The bearings 26, 27, 28, which are arranged on the respective ends of the upper rollers, are mounted on a frame 24, which is itself mounted on the machine frame MG, so that it can pivot about a pivot axle 22. In the lower position shown in FIG. 1, the frame 24 is in a working position in which the upper rollers 3, 5, 7 are resting on the lower rollers 2, 4, 6, wherein the frame is locked in this position by means of an apparatus (not shown). As indicated by dotted lines and by a double arrow, the frame 24 can also be pivoted upward about the pivot axle 22 into an out-of-operation position. In this pivot operation the upper rollers 3, 5, 7 are also pivoted which thus permits free access to the lower rollers 2, 4, 6.

During operation of the drafting system 1, soiling and other components from the fiber material G passed through may be deposited on the circumferential surfaces Z of the upper rollers 3, 5, 7. This may be further encouraged by an electrostatic charge on the upper rollers. These deposits would have negative effects on the drawing operation if they reach the respective clamping site K1-K3 in the revolution of the upper rollers. In other words, the clamping effect on the fiber material G is irregular due to the spots of deposits present on the roller surfaces, as seen over the width of the respective pair of rollers.

Stripping devices 9 consisting of a holder H and a stripper E having a stripping edge K are therefore provided for stripping away such deposits above the upper rollers 3, 5 and 7. The strippers are made of a flexible material (for example, plastic, rubber, etc.) and may be glued or otherwise joined to the holder.

Figure 2:
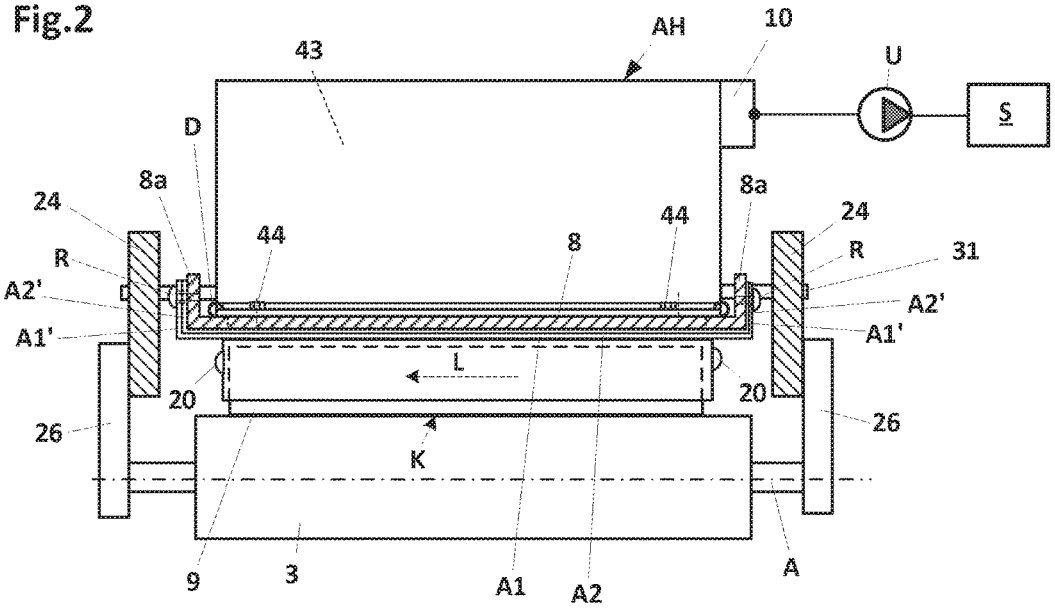
FIG. 2 shows a sectional diagram X-X according to FIG. 1.
Figure 1A:
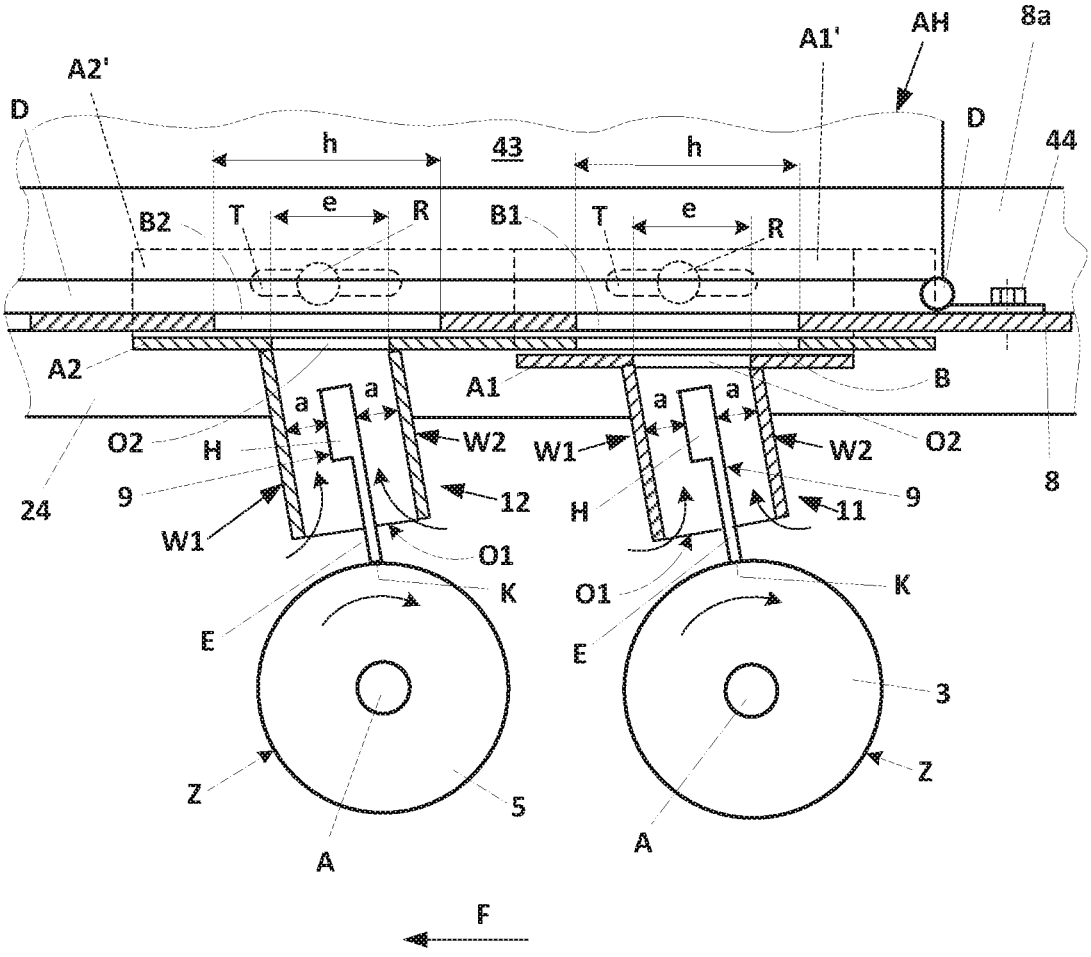
FIG. 1*a* shows an enlarged partial view according to FIG. 1.

The respective stripping devices 9 are each mounted inside a suction channel 11, 12 or 13 and are fastened at each of their ends to an outside wall of the respective suction channel by means of fastening means 20, shown schematically in FIG. 2, and held in the working position shown in FIGS. 1 and 1*a*. In this position the respective end of the stripper which is provided with the stripping edge K protrudes through a first opening O1 out of the respective suction channel by a certain length and sits on the circumferential surface Z of the respective upper roller under a prestress.

The stripping devices 9 (FIG. 1*a*) are arranged approximately centrally within the respective suction channel 11, 12 or 13—as seen transversely to their longitudinal direction L—and at a distance "a" of 2 to 10 mm from the front and/or rear channel wall W1 and/or W2, respectively. The stripping device 9 therefore has an air flow around it on both sides (indicated by arrows), which is created by applying a vacuum via a vacuum source U. This ensures that the material stripped off will not be deposited on the surface of the stripping device 9.

On the opposite side of the first opening O1, the respective suction channel 11, 12, 13 is provided with a second opening O2 which is opposite an opening B1, B2 or B3 in a bottom wall 8 on which the suction channel is mounted.

The bottom wall 8 is provided with flanged edges 8*a* protruding upward on both longitudinal sides, as seen in the direction of conveyance F.

The flanged edge 8*a* has elongated holes L1 and/or L2 on the respective front and rear ends through which bolts 30 and/or 31 protrude and are fastened on the frame 24 at each end. The bottom wall 8 is thus connected to the frame 24 by means of the bolts 30, 31. The bottom wall 8 can be shifted with respect to the frame 24 in the direction of conveyance F or opposite that direction through the corresponding alignment of the elongated holes L1, L2 (see FIG. 1). Between the flanged edges 8*a* and the frame 24, spacers (not shown) may be provided on the bolts 30, 31 to secure a central position (as shown in FIG. 2) of the bottom wall 8 within the frame parts of the frame 24 running laterally to the bottom wall.

Figure 1B:
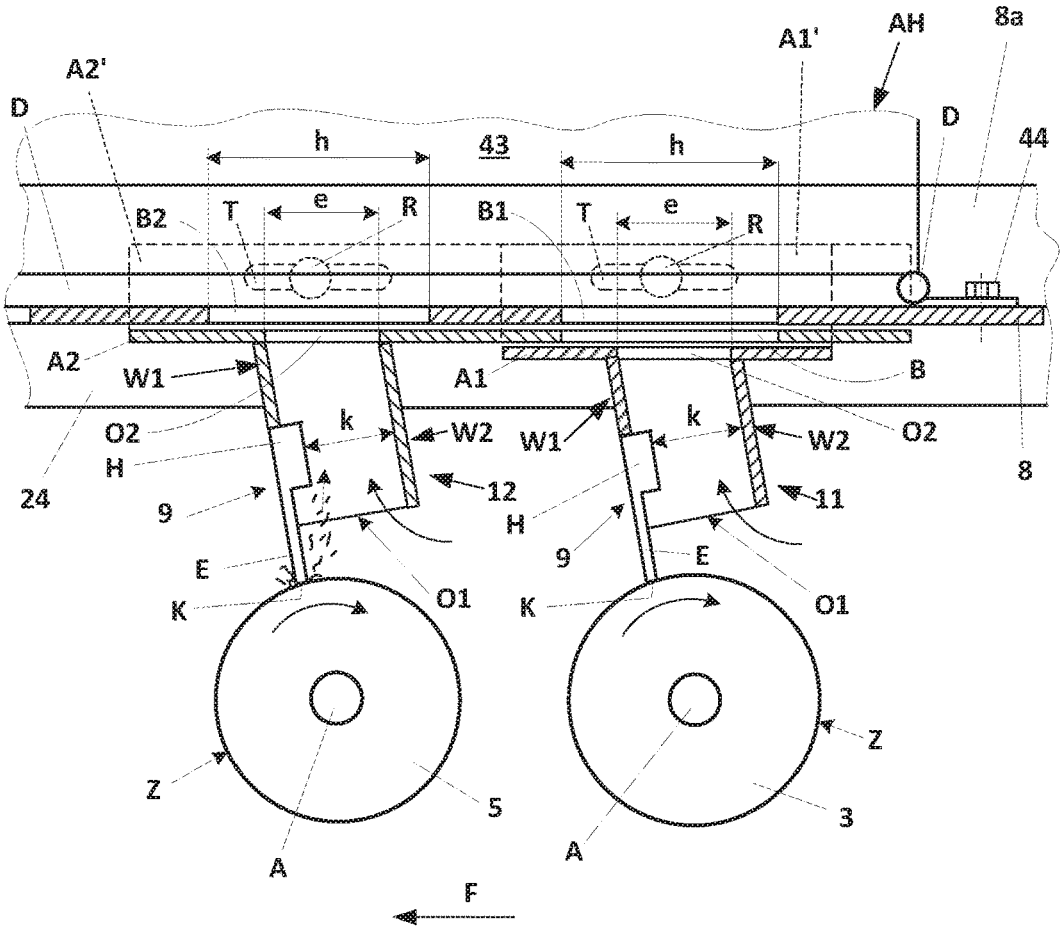
FIG. 1*b* shows another exemplary embodiment according to FIG. 1*a*.

FIG. 1*b* shows another exemplary embodiment, wherein the stripping devices 9 are fastened directly in the extension of the front side wall W1 of the respective suction channels 11, 12. In other words, the holder H is fastened to the front side wall W1 by means of fastening means which are not shown further here. This fastening may be designed in such a way that an advance of the stripper in the direction of the circumferential surface Z of the rollers 3, 5 is possible if the rollers must be dressed again, and their diameter is thereby reduced.

Such a readjustment of the strippers is also to be provided with the additional exemplary embodiments.

The stripping device 9 is at least partially opposite the rear side wall W2 of the respective suction channel 11 and/or 12 at a distance "k" of 8 to 20 mm. The end of the stripper E protrudes with its stripping edge K by a certain amount out of the respective suction channel 11 and/or 12 and sits on the circumference Z of the respective roller 3, 5.

As already described, the material stripped from the roller circumference Z due to the stripper E which is designed to be flexible and under the influence of the rotational movement of the rollers 3 and/or 5, which is indicated by an arrow, into the region behind the stripper (as seen in the direction of conveyance F) from which it is removed by suction in the direction of the suction hood AH by the suction air current (see arrow) applied to the suction channels 11, 12.

Figure 1C:
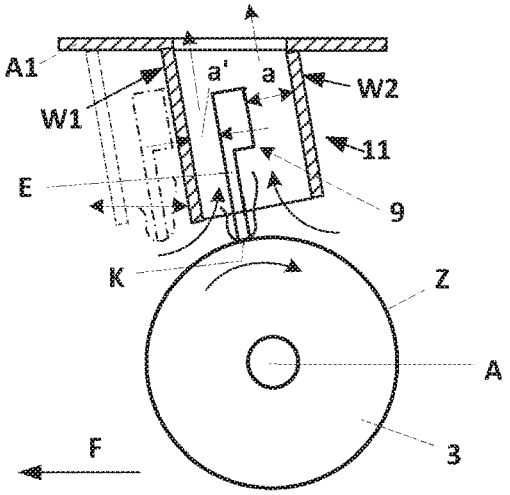
FIG. 1*c* shows a partial view according to FIG. 1*a* with another exemplary embodiment.

FIG. 1*c* shows schematically another embodiment according to FIG. 1*a* on the basis of the suction channel 11. In contrast with the embodiment in FIG. 1*a*, in the embodiment in FIG. 1*c*, the stripping device 9 is mounted eccentrically within the suction channel 11. The distance "a'" from the front side wall W1 is less than the distance "a" from the rear side wall W2. It would also be possible to reverse the ratios of the distance. This results in different channel cross sections on both sides of the stripping device 9. This results in the fact that the velocity of flow is greater in the area with the smaller distance "a'" than the velocity of flow in the area with the greater distance "a". Due to this effect, the fibers which are positioned around the stripping edge K of the stripper E, as shown schematically, become loosened again. This takes place when the channel 11 with the stripping device 9 is shifted periodically with respect to the axle A of the roller 3 for cleaning purposes (see the following example). In doing so, this stripping edge K is lifted up from the circumference Z of the roller 3 and enters a position indicated with dash-dot lines. Due to the greater air flow in the suction channel at the distance a', these fibers are released and picked up by the suction in this area and sent to the suction hood AH.

As shown in FIG. 1, at least one spring element 36, which is supported at its free end on the bolt 30, is mounted on a transverse web 33, which is itself mounted between the flanged edges 8*a*. The spring element 36 is designed as a compression spring and causes the bottom wall 8 to be displaced in the direction of travel F until the elongated hole L1 comes to a stop in the position on the bolt 30 shown in FIG. 1. Thus the bottom wall 8 is secured in the position shown (FIG. 1) opposite the frame 24.

Another transverse web 34 is provided between the flanged edges 8*a* on the end of the bottom wall 8 opposite the elongated holes L1. At least one bellows, which is fastened to a transverse web 40 of the frame 24, as shown schematically in FIG. 1, is hinge-connected to this transverse web 34. The bellows cylinder 38 is acted upon by a pressure source P. If the bellows cylinder 38 is acted upon by compressed air through the pressure source P, then a compressive force is applied to the frame 24 by means of the transverse web 34, displacing the latter in the direction opposite the direction of conveyance F and opposite the spring force of the spring 36. With this displacement, the frame 24 is guided over the elongated holes L1, L2 onto the bolt 30, 31. Since the suction channels 11, 12, 13 are fastened onto the bottom wall 8 (as will be described further below), these are also displaced with the stripping devices 9 fastened inside the suction channels. Due to this displacement movement, the respective stripping edge K is moved a distance away from the surfaces Z of the upper rollers 3, 5, 7, so that any deposits in the area of these stripping edges K can be loosened and removed by suction. As soon as the bellows cylinder 38 is no longer being acted upon by the pressure source P, the bottom wall 8 is conveyed back in the direction of conveyance F into its starting position by means of the spring force of the spring 36. The periodic displacement of the stripping devices 9 can take place through a corresponding controlled action of the bellows cylinder 38 in predetermined intervals of time.

As shown in the enlarged view in FIG. 1*a* in particular, cover elements A1, A2, A3 are mounted on the suction channels 11, 12, 13 in the area of the respective second opening O2, lying directly or indirectly thereon, leaving free the respective opening O2 beneath the bottom wall 8. These cover elements have lateral flanged edges A11, A21, A31 (FIG. 1), which are in direct or indirect contact with the flanged edge 8*a* of the bottom wall 8.

The lateral flanged edges A11 and A21 are provided with elongated holes T, through each of which a screw R protrudes by means of which the flanged edges A11 and A21 are connected to the flanged edge 8*a* of the bottom wall 8. By means of the elongated holes T, it is possible to displace the cover elements A1 and A2 with respect to the bottom wall 8—after loosening the screws R. Changes in the clamping distances in the pre-drawing VV and the main drawing HV can thus be compensated with the masses c and d.

In other words, as soon as one of the roller pairs 2, 3 or 4, 5 has been shifted with respect to the direction of conveyance F to change the distance c or d between the clamping lines K1, K2 and/or K2, K3, the corresponding stripping devices 9 may be adapted in their position. This ensures that the stripping devices will always be in the correct stripping position with respect to the similarly assigned upper roller.

The foremost roller pair 6, 7 (as seen in the direction of conveyance F) is mounted fixedly. The front suction channel 13 is therefore also attached fixedly to the bottom wall 8. Then the cover element A3 mounted on the suction channel 13 is in direct contact with the bottom wall 8 wherein the opening O2 in the suction channel 13 and the opening B3 in the bottom wall 8 are directly opposite one another. For fastening the suction channel 13 to the bottom wall 8, the cover element A3 has a lateral flanged edge A31, which is directly in contact with the lateral flanged edge 8*a* of the bottom wall 8. The flanged edge A31 is fastened to the flanged edge 8*a* by means of screws R. The flanged edge 31 is therefore provided with holes through which the screws R can pass.

To be able to carry out such a displacement of the suction channels 11 and/or 12 wherein the free passage from the second openings O2 of the suction channels 11 and/or 12 into the interior 43 of the following suction hood AH must be ensured, it is necessary to provide the openings B1 and B2 of the bottom wall 8—as seen transversely to the longitudinal direction L of the stripping device 9—with a width h, which is greater than the width e of the second opening O2 of the respective suction channel 11, 12. The opening B1 and/or B2 protrudes beyond the openings O2 on both sides around the extent of the possible adjustment.

To avoid collisions between cover elements A1 and A2 in a certain adjustment of the position of the suction channels 11, 12, the cover element A2 sits directly on the bottom wall 8 (FIG. 1*a*) and extends over the cover element A1, which is in contact with the cover element A2. Here again, to ensure free passage in any position of the suction channel 11 from the second opening O2 of the suction channel 11 to the interior 43 of the suction hood AH in any position of the suction channel 11, the cover element A2 is provided with another opening B, whose width corresponds approximately to the width h of the opening B1.

This ensures that the interior 43 of the suction hood AH is shielded with respect to the ambient air in any position of the suction channels 11, 12, except for the openings O2.

This ensures an extensive and targeted suction of the stripped constituents in the area of the suction channels 11 to 13.

The components entering the interior 43 of the suction hood AH are transferred to a collective storage S, which is indicated schematically, under the influence of a vacuum source U connected to the suction hood AH. The vacuum source U is connected at a tubular connection part 10, which is situated in an upper area of the suction hood AH.

The suction hood which sits on the bottom wall 8 by means of a peripheral seal D protrudes beyond the openings B1 to B3 of the bottom wall 8 in the area of their contact. The suction hood AH is fastened to the bottom wall 8 by means of fastening means 44 (e.g., screws), shown schematically here.

In other words, the suction hood AH is mounted so that it can be dismantled and can be removed at any time for example, to carry out cleaning work or to eliminate problems. The suction hood may be made of a transparent material so that the monitoring of the interior 43 of the suction hood is simplified.

The apparatus proposed here permits intensive suction removal of components stripped away from the roller and a simple adjustment of the apparatus to different distortion distances during pre-drawing or main drawing of the drafting system due to the proposed mounting of adjustable suction channels that are provided with stripping devices.

Modifications and variations can be made to the embodiments illustrated or described herein without departing from the scope and spirit of the invention as set forth in the appended claims.

The invention claimed is:

1. A spinning preparation machine for processing a fiber material, comprising:

a drafting system that moves the fiber material in a direction of conveyance, the drafting system comprising a plurality of roller pairs arranged one after the other with upper rollers and lower rollers;

at least two elongated stripping devices, each stripping device comprising a stripping edge in contact with one of the upper rolls to remove dirt and other contaminants;

a suction hood mounted above the stripping devices and connected to a vacuum source;

each stripping device mounted in an individual respective suction channel, and the stripping edge of the stripping device protrudes through a first opening in the respective suction channel;

each suction channel mounted on a bottom wall having openings therein;

each suction channel comprising a second opening opposite the first opening, the second opening aligned opposite from one of the openings in the bottom wall; and the suction hood protrudes beyond the openings in the bottom wall and is mounted on a side of the bottom wall opposite the suction channels.

2. The spinning preparation machine according to claim 1, wherein at least one of the suction channels is displaceable along the bottom wall in a longitudinal direction of the stripping devices.

3. The spinning preparation machine according to claim 2, wherein a width dimension of the opening in the bottom wall is larger than a width dimension of the second opening of the displaceable suction channel opposite the respective opening in the bottom wall.

4. The spinning preparation machine according to claim 3, further comprising a cover element configured at the second opening in the displaceable suction channel, the cover element closing a portion of the opening in the bottom wall that protrudes beyond the second opening in the displaceable suction channel.

5. The spinning preparation machine according to claim 1, wherein front and rear channel walls of the respective suction channels are at a distance between 2 and 10 mm from the stripping device, the stripping device comprising longitudinal ends fastened to their respective suction channel.

6. The spinning preparation machine according to claim 5, wherein the distances of the stripping device from the front and rear channel walls are different.

7. The spinning preparation machine according to claim 1, wherein the suction channels comprise front and rear channel walls relative to the direction of conveyance of the fiber material, the stripping device of each suction channel mounted to an extension of the front channel wall and at a distance between 8 and 20 mm from the rear channel wall.

8. The spinning preparation machine according to claim 1, further comprising a frame pivotably mounted with a pivot axle to a machine frame, the pivot axle parallel to a longitudinal direction of the stripping devices, wherein the bottom wall is fastened to a frame, and wherein bearings for the upper rollers are mounted to the frame.

9. The spinning preparation machine according to claim 8, wherein the bottom wall is mounted so as to be movable along the frame in a direction transverse to the longitudinal direction of the stripping device, the bottom wall held in a working position on the frame by a spring element connected between the frame and the bottom plate, the bottom plate displaceable along the frame by an adjusting device mounted between the frame and the bottom wall.

10. The spinning preparation machine according to claim 9, wherein the adjusting device comprises a pneumatic bellows cylinder.

11. The spinning preparation machine according to claim 1, wherein the suction hood is fastened to the bottom wall and comprises peripheral sealing elements in contact with the bottom wall.

12. The spinning preparation machine according to claim 1, wherein the suction hood is made of a transparent material.

* * * * *